US010378715B2

(12) United States Patent
Bushre

(10) Patent No.: US 10,378,715 B2
(45) Date of Patent: Aug. 13, 2019

(54) SOLID-STATE VEHICLE HEADLAMP HAVING SPHERODIAL REFLECTOR OPTIC AND CLAMSHELL REFLECTOR

(71) Applicant: Adam Bushre, Saranac, MI (US)

(72) Inventor: Adam Bushre, Saranac, MI (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 15/686,824

(22) Filed: Aug. 25, 2017

(65) Prior Publication Data

US 2019/0063716 A1 Feb. 28, 2019

(51) Int. Cl.
*F21S 41/36* (2018.01)
*F21S 41/147* (2018.01)
*F21S 41/33* (2018.01)

(52) U.S. Cl.
CPC ..... *F21S 41/36* (2018.01); *F21S 41/147* (2018.01); *F21S 41/337* (2018.01)

(58) Field of Classification Search
USPC ..... 362/516
See application file for complete search history.

(56) References Cited

U.S. PATENT DOCUMENTS 8,931,920 B2 1/2015 Tessnow
2010/0118558 A1* 5/2010 Tsukamoto ..... B60Q 1/0041 362/517

* cited by examiner

*Primary Examiner* — Rafferty D Kelly
(74) *Attorney, Agent, or Firm* — Edward S. Podszus

(57) ABSTRACT

A solid-state automotive vehicle headlamp includes a solid-state light source (SSLS), a clamshell reflector, and a reflector optic. The clamshell reflector includes a reflective surface defining a clamshell cavity with an open end facing a field to be illuminated. The reflector optic is defined by a portion of a spherical surface in surrounding relation to the SSLC. The reflector optic defines a light-transmissive window permitting a direct line-of-sight transmission of light generated by the SSLC to the reflective surface of the clamshell reflector. The reflector optic further includes a reflective region at least partially surrounding the light-transmissive window and configured to reflect light generated by the SSLC and directed at the reflector optic back towards the SSLC. The reflector optic redirects some of the light emitted by the SSLC through the light-transmissive window towards the clamshell reflector to create a more controlled beam pattern and increase the overall light output.

20 Claims, 4 Drawing Sheets

SOLID-STATE VEHICLE HEADLAMP HAVING SPHERODIAL REFLECTOR OPTIC AND CLAMSHELL REFLECTOR

FIELD

The present disclosure relates generally to automotive headlamps, and in particular, to automotive headlamps including a clamshell reflector in combination with a solid-state light source that emits light in an approximately hemispherical light distribution.

BACKGROUND

Solid-state light sources (such as light emitting diodes (LED)) are commonly used in vehicle lighting applications, such as head lights, break lights, fog lights, and so on. As may be appreciated, LED sources may emit light in an approximately hemispherical light distribution. Often, such vehicle lights utilize a clamshell reflector which includes a reflector for receiving and reflecting light generated by an LED light source towards a field to be illuminated. However, only light which is properly directed out from such clamshell reflectors may be utilized when performing measurements to determine whether a lighting device meets an applicable industry standard. For instance, in the context of vehicle headlamps, only light which is directed within a predefined light beam pattern (e.g., but not limited to, a low beam light pattern) may be measured when determining total lumen output in compliance with industry standards. As such, light that is not directed from the clamshell reflector may be generally considered to be lost or otherwise wasted, ultimately reducing optical performance. In addition, light that is not properly directed from the clamshell reflector may result in glare, which may result in the vehicle headlamp failing regulatory requirements.

Accordingly, it would be advantageous to have a solid-state light lighting device that reduces losses associated with a light source that emits light in a hemispherical light distribution, and in particular, a clamshell reflector configuration allowing for a host of lighting applications (e.g., headlamps, tail lights, fog lights, etc.) to meet increased light output, efficiency, and/or light beam pattern requirements governed by existing and future standards.

BRIEF DESCRIPTION OF THE DRAWINGS

Reference is now made to the following detailed description which should be read in conjunction with the following figures, wherein like numerals represent like parts.

DETAILED DESCRIPTION INCLUDING BEST MODE OF A PREFERRED EMBODIMENT

Figure 1:
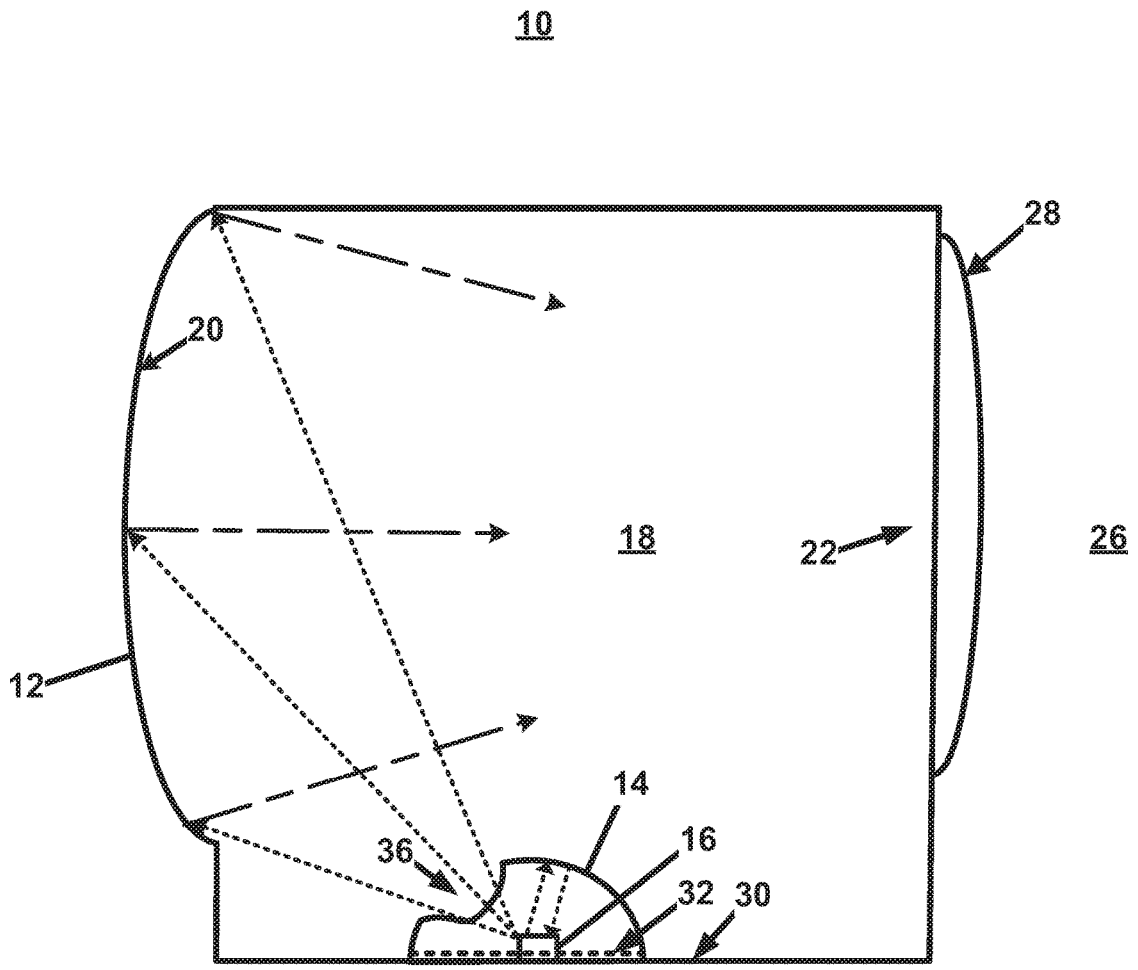
FIG. 1 shows an example lighting device consistent with an embodiment of the present disclosure.

In general, one embodiment of the present disclosure features a solid-state automotive vehicle headlamp. In more detail, the solid-state automotive vehicle headlamp includes a solid-state light source, a clamshell reflector, and a reflector optic. The clamshell reflector includes a reflective surface defining a clamshell cavity with an open end facing a field to be illuminated. The reflector optic is defined by a portion of a spherical surface in surrounding relation to the solid-state light source. The reflector optic defines a light-transmissive window permitting a direct line-of-sight transmission of light generated by the solid-state light source to the reflective surface of the clamshell reflector. The reflector optic further includes a reflective region at least partially surrounding the light-transmissive window and configured to reflect light generated by the solid-state light source and directed at the reflector optic back towards the solid-state light source. As described herein, a reflector optic of the solid-state automotive vehicle headlamp consistent with at least one embodiment of the present disclosure redirects some of the light emitted by the solid-state light source through the light-transmissive window towards the clamshell reflector to create a more controlled beam pattern and increase the overall light output compared to traditional solid-state automotive vehicle headlamps.

Turning now to FIGS. 1-4, FIG. 1 generally illustrates a cross-sectional view of a solid-state automotive vehicle headlamp 10 consistent with an embodiment of the present disclosure. The solid-state automotive vehicle headlamp 10 is shown in a simplified form and other configurations are within the scope of this disclosure. Although specific examples herein include the solid-state automotive vehicle headlamp 10 implemented within an automotive headlamp, this disclosure is not necessarily limited in this regard. For example, the solid-state automotive vehicle headlamp 10 may be used in marine, aerospace, or any other lighting application in which a solid state light source (e.g., including one or more LEDs) is used in combination with a reflector.

As shown, the solid-state automotive vehicle headlamp 10 may include a clamshell reflector 12, a spheroid reflector optic 14, and one or more solid-state light sources 16. The clamshell reflector 12 defines a clamshell cavity 18 including one or more reflective surfaces 20 and an open end 22. In the embodiment shown, the clamshell reflector 12 includes a reflective surface 20 that is disposed generally opposite to the open end 22, though it should be appreciated that the present disclosure is not limited in this regard unless specifically claimed as such. The reflective surface 20 may receive light generated by the solid-state light source 16 and reflect the same towards the open end 22 to at least partially illuminate a field 26 external to the solid-state automotive vehicle headlamp 10. Thus, the reflective surface 20 may be described as facing a field to be illuminated 26.

The reflective surface 20 may be disposed on at least a portion of an inner and/or outer surface of the clamshell reflector 12. The reflective surface 20 may include any material configured to reflect a substantial portion (e.g., at least 80%) of incident light received from the spheroid reflector optic 14. In some cases, the reflective surface 20 may be configured to reflect at least 85% of incident light, and in some cases, up to 100% of incident light. By way of a non-limiting example, the reflective surface 20 may be formed from metallization or other suitable process.

As noted herein, reflective surface 20 is configured to reflect light from the spheroid reflector optic 14 towards the open end 22. Depending on the application, the reflective surface 20 may be configured to focus the light towards the open end 22 in one or more light distribution patterns to illuminate the field 26 and/or may be configured to reflect the light onto one or more optional lens 28 disposed adjacent to the open end 22. In the later embodiment, the resulting light distribution pattern(s) of the solid-state automotive vehicle headlamp 10 may ultimately be controlled by the configuration of the lens 28 rather than the reflective surface 20.

In either embodiment, the reflective surface 20 may have a generally convex profile. It may be appreciated that the specific size, shape, and contour (e.g., the profile) of the reflective surface 20 may therefore depend on the intended application. For example, the profile of the reflective surface 20 may depend on the overall size of the solid-state automotive vehicle headlamp 10, the desired light distribution pattern for illuminating the field 26, the configuration and placement of the spheroid reflector optic 14 relative to the reflective surface 20, and/or the placement and profile of the optional lens 28.

The clamshell reflector 12 may be adapted to receive at least one solid-state light source 16 at least partially within the clamshell cavity 18. As shown, the solid-state light source 16 is coupled to a bottom surface 30 of the clamshell reflector 12, though it should be appreciated that the solid-state light source 16 may be coupled to an optional bottom surface 32 (shown in dotted lines) of the spheroid reflector optic 14 as described herein. In either embodiment, at least a portion of the bottom surface(s) 30, 32 may include a printed circuit board (PCB) or other suitable substrate. Therefore, the solid-state light source 16 may be coupled electrically and/or physically to the bottom surface(s) 30, 32. The bottom surface(s) 30, 32 may also be thermally conductive and operate as a heatsink to draw and disperse heat from the at least one solid-state light source 16 during operation. Optionally, a least a portion of the bottom surface(s) 30, 32 may include a reflective region 24 disposed at least within reflector optic 14 and proximate to the solid-state light source 16. The reflective region 24 is configured to reflect light back towards the reflective regions/surfaces 34.

Figure 2:
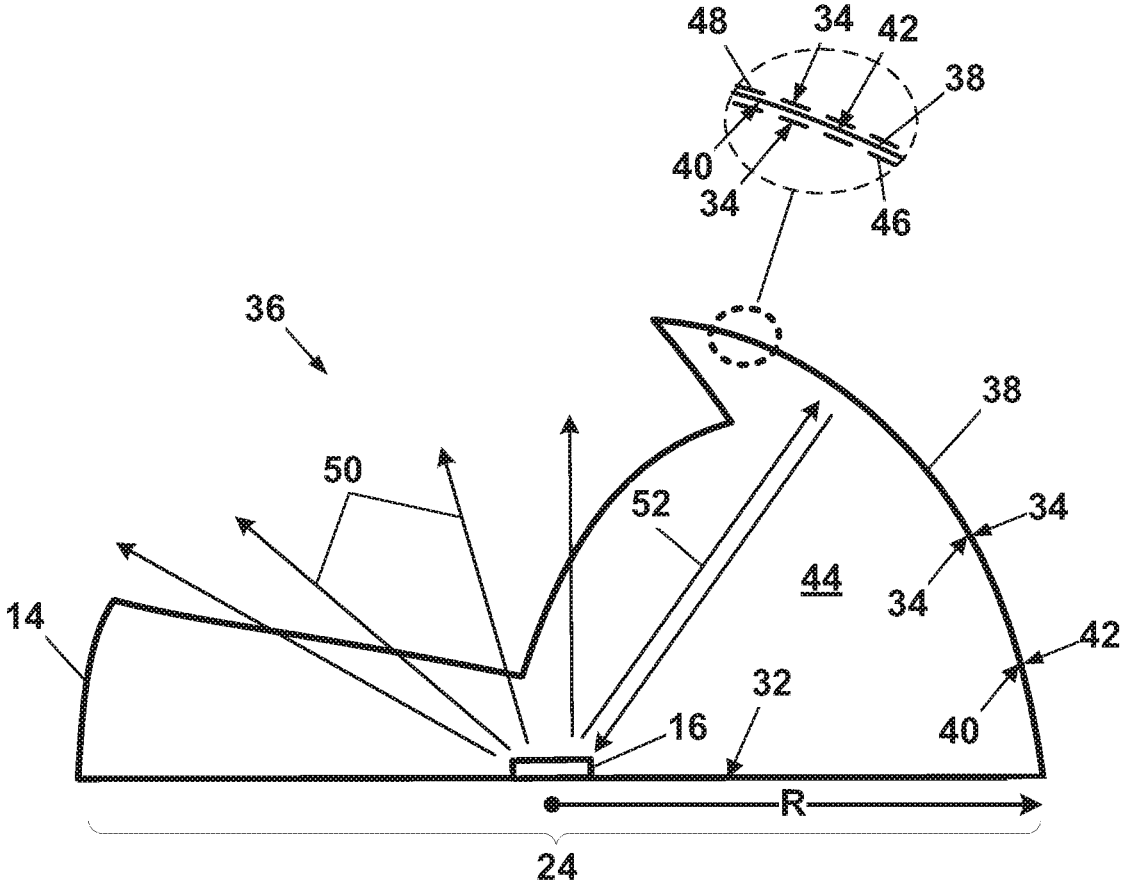
FIG. 2 shows cross-sectional view of an example reflector optic consistent with an embodiment of the present disclosure.

The solid-state automotive vehicle headlamp 10 also includes a spheroid reflector optic 14 (which may be referred to as a reflector optic 14) that is at least partially disposed within the clamshell cavity 18. With reference to FIG. 2, an example cross-sectional view of the reflector optic 14 is shown in accordance with an embodiment of the present disclosure. At least a portion of the reflector optic 14 may have a substantially hemispherical shape that at least partially surrounds the solid-state light source 16. The reflector optic 14 includes one or more reflective regions/surfaces 34 and a light-transmissive window 36. As described further below, the reflective region 34 at least partially surrounds the light-transmissive window 36 and is configured to a reflect light generated by the solid-state light source 16 and directed at the reflector optic 14 back towards the solid-state light source 16, and through the light-transmissive window 36 onto the reflective surface 20 of the clamshell reflector 12.

The reflector optic 14 may include a body 38 defined by one or more substantially spherical surfaces, e.g., inner surface 40 and/or outer surface 42. It should be appreciated that the spheroidal reflector optic 14 is a portion of spherical surface, preferably approximating a hemisphere. It may be appreciated that the spheroidal reflector optic 14 may be approximated by an n-faceted polygon.

The body 38 may be in surrounding relation to the solid-state light source 16 such that the inner surface 40 of the body 38 at least partially surrounds the solid-state light source 16 to receive incident light generated by the same. In some cases, the body 38 optionally includes a bottom or base surface 32 to which the solid-state light source 16 may be directly or indirectly coupled. In other cases, such as shown in FIG. 1, the reflector optic 14 may not include the base surface 32, and the solid-state light source 16 may be coupled (either directly or indirectly) to the bottom surface 30 of the clamshell reflector 12.

The body 38 may be formed from a light transmissive material such as, for example, plastic, glass, and/or silicone. In some cases, the body 38 is hollow such that an interior space/cavity (e.g., a reflector optic cavity 44) is provided between the inner surface 40 of the body 38 and the solid-state light source 16. In other cases, the body 38 is a solid such that the interior space 44 between the solid-state light source 16 and the inner surface 40 is filled with a light transmissive material.

In any such cases, the body 38 may include one or more reflective regions/surfaces 34, which may at least partially surround the solid-state light source 16. The reflective regions/surfaces 34 may include one or more layers of highly reflective material. As referred to herein, highly reflective material refers to a material with a reflectivity of at least 80%, for example, at least 85%, and more preferably at least 90%, for incident light. For example, the reflective regions/surfaces 34 may be formed via one or more metallic layers 46 disposed on the inner surface 40 of the body 38. In other cases, the reflective regions/surfaces 34 may be preferably formed via one or more metallic layers 48 disposed on the outer surface 42 of the body 38.

The one or more reflective regions/surfaces 34 may also at least partially surround the light-transmissive window 36. Preferably, the one or more reflective regions/surfaces 34 fully surround the light-transmissive window 36. For example, the light-transmissive window 36 may be formed by a masked area which may be removed after forming (e.g., depositing) of one or more metallic layers 46/48 onto the body 38 to expose the light-transmissive material forming the body 38. However, the light-transmissive window 36 may be formed by simply removing a portion of the regions/surfaces 34 (e.g., but not limited to, a portion of metallic layers 46 and/or 48) from the body 38, and the provided example should not be construed as limiting. In some cases, both metallic layers 46 and 48 may be deposited, although deposition of one layer is preferable.

In another embodiment, the body 38 may be formed from a metal or metal alloy or other suitably reflective material and may not necessarily include an additional layer to increase reflectivity, e.g., metallic layers 46, 48. In this embodiment, the body 38 may be formed or otherwise made hollow, and the light the light-transmissive window 36 may be provided by removing a portion of the body 38. Alternatively (or in addition), light transmissive material may be disposed in the hollow metal body 38. Thus, the reflector optic 14 may comprise a first material defining its body 38 (e.g., providing inner and outer surfaces 40 and 42) and a second material at least partially filling the space between the inner surface 40 and the solid-state light source 16.

As noted herein, the reflector optic 14 defines a light-transmissive window 36 to permit a direct line-of-sight transmission of light generated by the solid-state light source 16 to the reflective surface 20 of clamshell reflector 12. The solid-state light source 16 may be configured to emit light in a generally hemispherical light pattern within the reflector optic 14. The generally hemispherical light pattern may be considered to have a first portion 50 and a second portion 52 as described herein.

The first portion 50 of the generally hemispherical light pattern includes light that is directly emitted from the solid-state light source 16 through the light-transmissive window 36 towards the reflective surface 20 of the clamshell reflector 12. Thus, the first portion 50 of the light pattern is light in a direct line-of-sight transmission from the solid-state light source 16 through the light-transmissive window 36 to the reflective surface 20.

The second portion 52 of the generally hemispherical light pattern is light that is emitted from the solid-state light source 16 towards one or more reflective regions/surfaces 34 of the reflector optic 14 (e.g., as shown in FIG. 2). The reflective regions/surfaces 34 of the reflector optic 14 are configured to reflect at least some of the second portion 52 of light back towards the solid-state light source 16 and/or the bottom surface(s) 30, 32. The second portion 52 of light thus reflects against the reflective regions/surfaces 34 as well as the solid-state light source 16 and/or the bottom surface 30, 32 in different directions until the light is redirected through the light-transmissive window 36 towards the reflective surface 20 of the clamshell reflector 12.

The alignment of the light-transmissive window 36 within the reflector optic 14, the size and dimensions of the light-transmissive window 36, the placement of the reflector optic 14 relative to the reflective surface 20, and/or the placement of the solid-state light source 16 within the reflector optic 14 may be selected such that all or substantially all of the light is emitted through the light-transmissive window 36 onto specific portions or regions of the reflective surface 20. The specific portions or regions of the reflective surface 20 onto which light is emitted may be within an outer edge or perimeter of the reflective surface 20 (e.g., a physical boundary where the reflective surface 20 ends) and/or within only desired portion(s) of the reflective surface 20 upon which light from the reflector optic 14 is to be reflected towards the open end 22.

Without the reflector optic 14 of the present disclosure, the second portion 52 of light emitted from the solid-state light source 16 (e.g., light that is not within the first portion of the generally hemispherical light pattern) is not emitted onto the specific portions or regions of the reflective surface 20 of the clamshell reflector 12 and not reflected towards the open end 22 in a controlled beam pattern. As a result, light in the second portion 52 may be emitted outside of the desired beam pattern (or not emitted at all) and does not contribute to the illumination of the field 26 (and therefore may be considered to be wasted). Consequently, the overall efficiency and lumen output of a solid-state automotive vehicle headlamp without the reflector optic 14 of the present disclosure is reduced. Additionally, light emitted outside of the desired light beam pattern may cause glare/distractions to drivers in on-coming traffic. As such, a solid-state automotive vehicle headlamp without the reflector optic 14 of the present disclosure may not meet applicable vehicle headlamp requirements.

To this end, optical simulations were performed for both a solid-state automotive vehicle headlamp 10 having a clamshell reflector 12 and a reflector optic 14 configured in accordance with an embodiment of the present disclosure and for a traditional solid-state automotive vehicle headlamp having a clamshell reflector but without the reflector optic 14 of the present disclosure. In each case, the optical simulations were based on solid-state automotive vehicle headlamps having a clamshell reflector including a reflective surface with a reflectivity of 85%. The reflector optic 14 of the solid-state automotive vehicle headlamp 10 in accordance with the present disclosure also included reflective regions/surfaces 34 having a reflectivity of 85% and included a solid-state light source 16 having a LED with a phosphor plate with a reflectivity of 75% and the bottom surface 30 with a reflectivity of 50%.

The optical simulations show that a traditional solid-state automotive vehicle headlamp has a less controlled beam patterned and reduced lumen output compared to a solid-state automotive vehicle headlamp 10 consistent with the present disclosure. By way of a non-limiting example, the optical simulations of the traditional solid-state automotive vehicle headlamp had a total lumen output of 323 and a peak candela of 40,200, whereas the optical simulations of the solid-state automotive vehicle headlamp 10 consistent with the present disclosure had total lumen output of 405 lumens (e.g., approximately a 25.4% increase) and a peak candela of 52,800 (e.g., approximately a 31.3% increase).

In the simulations, the traditional solid-state automotive vehicle headlamp emitted light above the horizon due to the imprecise manner in which the light is emitted from the LED to the clamshell reflector. As may be appreciated, light that is emitted above the horizon can cause glare to oncoming traffic. In addition, the light emitted above the horizon is generally considered to be unused because it does not contribute to the useable light emitted by the lighting device, thereby reducing the overall usable lumen output and efficiency of the traditional solid-state automotive vehicle headlamp.

In contrast, the improved beam pattern (e.g. added control of the light) of the solid-state automotive vehicle headlamp 10 consistent with the present disclosure reduces glare to oncoming traffic (thereby allowing the solid-state automotive vehicle headlamp 10 to potentially meet more stringent headlamp requirements). In addition, since more light is emitted in the desired beam pattern, the overall lumen output of the solid-state automotive vehicle headlamp 10 consistent with the present disclosure is increased compared to the traditional solid-state automotive vehicle headlamp. As a result, a solid-state automotive vehicle headlamp 10 consistent with the present disclosure may have increased lumen output compared to traditional lighting devices, may use less expensive LEDs (e.g., with lower source lumens), and/or reduced drive current (thereby reducing the thermal load on the system) compared to a traditional solid-state automotive vehicle headlamp.

The reflector optic 14 of the present disclosure redirects at least some of the light in the second portion 52 towards the specific portions or regions of the reflective surface 20 of the clamshell reflector 12 where it can be reflected towards the open end 22 to illuminate the field 26 in a controlled beam pattern. As such, the reflector optic 14 of the present disclosure improves the overall performance (e.g., increase the efficiency, increase the measurable lumen output, and provide a more controlled beam pattern) of a solid-state automotive vehicle headlamp 10 compared to a solid-state automotive vehicle headlamp 10 without the reflector optic 14.

Figure 3:
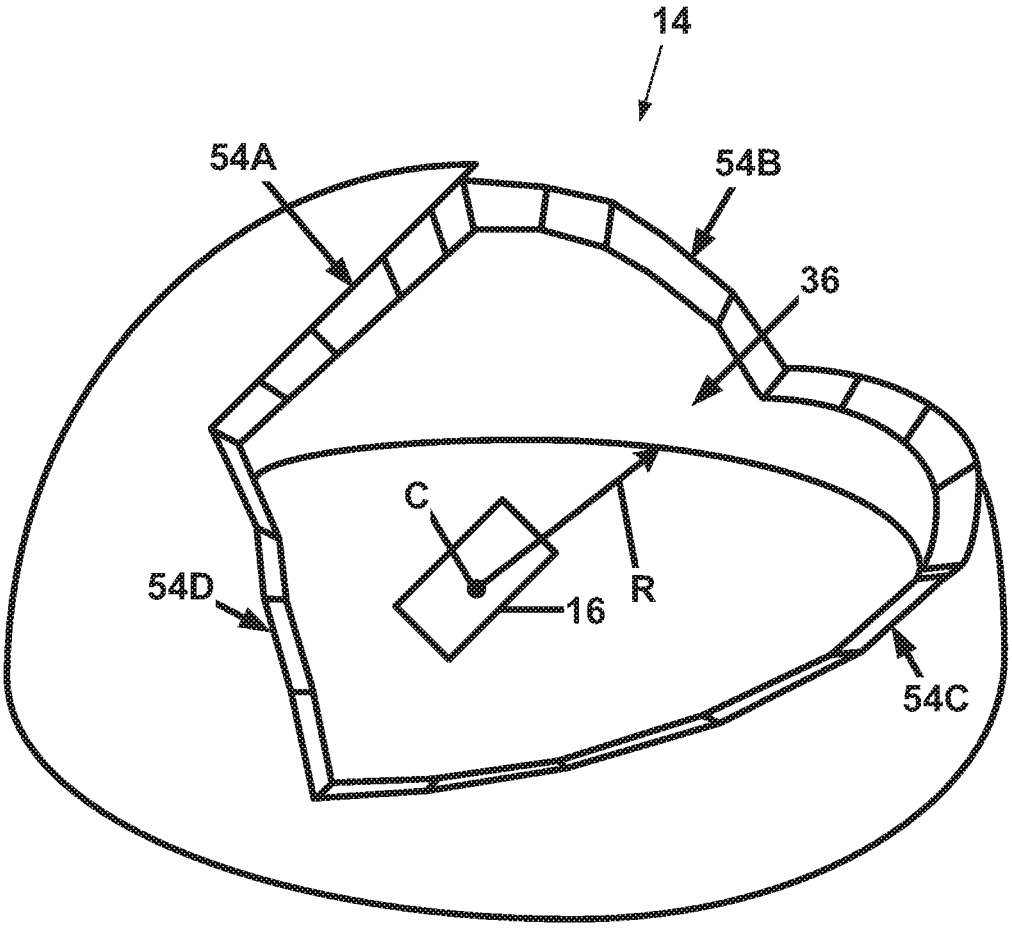
FIG. 3 shows a perspective view of an example reflector optic consistent with an embodiment of the present disclosure.

With reference to FIG. 3, the light-transmissive window 36 may be defined by one or edges 54 which bound the light-transmissive window 36. The edge(s) 54 may be substantially planar/flat, although this disclosure is not necessarily limited in this regard. According to one embodiment, the negative shape defined by the edges 54 may form a substantially rectangular shape, e.g., a rectangular shape flattened against the spherical body 38. It should be appreciated, however, that this is merely one example and that the particular shape chosen for the light-transmissive window 36 may vary based on a desired reflector shape for the clamshell reflector 12. For example, the shape of the light-transmissive window 36 may be substantially circular or oval that is bounded by a single continuous edge 54 and may be used in combination with a clamshell reflector 12 having a circular/oval reflector surface 20.

The position of the solid state light source 16 within the reflector optic 14 may be utilized when selecting a particular radius R for the reflector optic 14 and the dimensions of the light-transmissive window 36. A process for designing the reflector optic 14 may include modeling and simulation to confirm that the light pattern emitted from the light-transmissive window 36 extends onto the desired portions/regions of the reflective surface 20 of the clamshell reflector 12. In at least one embodiment, the solid-state light source 16 may be positioned within the reflector optic 14 such that at least a portion of the solid-state light source 16 is on and/or substantially adjacent to the center (e.g., origin) C of the theoretical sphere that defines substantially hemispherical shape of the reflector optic 14. As used herein, substantially adjacent to the center C of the reflector optic 14 is intended to mean that the solid-state light source 16 is disposed a distance from the center C of the reflector optic 14 that is equal to or less than 10% of the radius R of the reflector optic 14.

Figure 4:
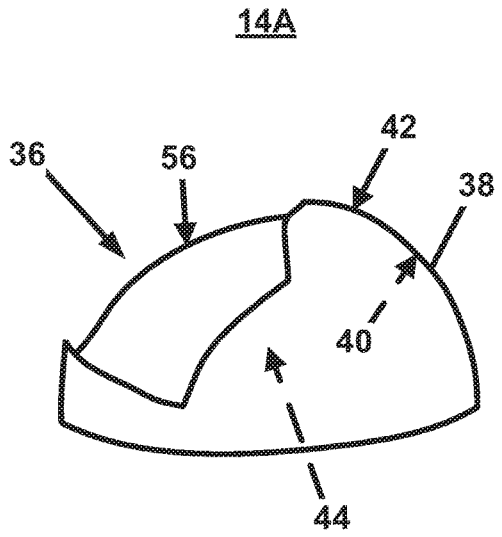
FIG. 4 shows a perspective view of another example reflector optic consistent with an embodiment of the present disclosure.
Figure 5:
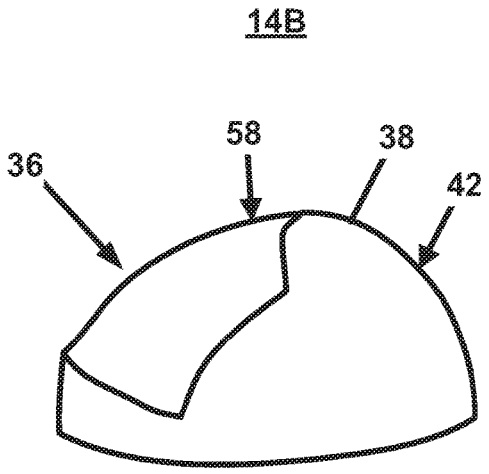
FIG. 5 shows a perspective view of another example reflector optic consistent with an embodiment of the present disclosure.

Turning to FIG. 4, an example reflector optic 14A is shown in accordance with an embodiment. As shown, the example reflector optic 14A includes a light-transmissive window 36 with a recessed surface 56. The recessed surface 56 may be formed by a light-transmissive material. In this embodiment, the body 38 may be formed hollow (with a reflective surface on the inner and/or outer surfaces 40, 42) and a light-transmissive material, e.g., optical grade silicone, may be disposed in the body 38 to fill the reflector optic cavity 44 of the hollow body 38. The recessed surface 56 of the light transmissive material may therefore be substantially flush with the inner surface 40 of the body 38. Alternatively, a solid body 38 may be formed from a light transmissive material and then a layer of metallic material 48 may be formed on the outer surface 42 of the body 38. Thereafter, a portion of the metallic material layer 48 may be removed to expose the recessed surface 56, and by extension, form the light-transmissive window 36. FIG. 5 shows another example reflector optic 14B in accordance with an embodiment. As shown, the reflector optic cavity 44 of the hollow body 38 is filled with a light transmissive material such that an exposed surface 58 of the light transmissive material within the light transmissive window 12 is substantially flush with or otherwise extends beyond the outer surface 42 of the body 38.

As noted herein, the solid-state automotive vehicle headlamp 10 may optionally include at least one lens 28 (FIG. 1) disposed adjacent to the open end 22. The lens 28 may be configured to reflect light received from the reflective surface 20 and emit the light in one or more light distribution patterns towards a field to be illuminated 26. In some cases, the lens 28 may be adapted to diffuse/disperse the light emitted therefrom. Alternatively (or in addition), the lens 28 may be adapted to convert light received from the clamshell reflector 12 and convert at least some of the light from a first wavelength (or wavelength range) to a secondary wavelength (or wavelength range). For instance, light may be generated in an initial or primary wavelength (e.g., but not limited to, blue light) and the lens 28 may at least partially convert at least a portion of the light from the initial wavelength to a secondary wavelength (e.g., but not limited to, wavelengths associated with red). In other cases, the lens 28 may be substantially transparent and configured to transmit the light received from the clamshell reflector 12 without conversion and/or dispersion. The shape and configuration of the lens 28 may vary depending on a desired configuration. To this end, the particular lens configuration shown is not intended to be limiting.

As used herein, the term "optically transparent" or "light transmissive" when used in connection with a material means that the referenced material transmits greater than or equal to about 80% of incident light, such as greater than or equal to about 90%, greater than or equal to about 95%, greater than or equal to about 99%, or even about 100% of incident light.

As used herein, a solid-state lighting (SSL) source refers to a type of lighting that uses semiconductor light-emitting diodes (LEDs), organic light-emitting diodes (OLED), or polymer light-emitting diodes (PLED) as sources of illumination. The terms, "light emitting diode," "LED," and "LED light source" are used interchangeably herein, and refer to any light emitting diode or other type of carrier injection/junction-based system that is capable of generating radiation in response to an electrical signal. Thus, the term LED includes but is not limited to various semiconductor-based structures that emit light in response to current, light emitting polymers, light emitting strips, electro-luminescent strips, combination thereof and the like. In particular, the term LED refers to light emitting diodes of all types (including semiconductor and organic light emitting diodes) that may be configured to generate light in all or various portions of one or more of the visible, ultraviolet, and infrared spectrum. Non-limiting examples of suitable LEDs that may be used include various types of infrared LEDs, ultraviolet LEDs, red LEDs, green LEDs, blue LEDs, yellow LEDs, amber LEDs, orange LEDs, and white LEDs. Such LEDs may be configured to emit light over a broad spectrum (e.g., the entire visible light spectrum) or a narrow spectrum.

As used herein, the term "on" may be used to describe the relative position of one component (e.g., a first layer) relative to another component (e.g., a second layer). In such instances the term "on" is understood to indicate that a first component is present above a second component, but is not necessarily in contact with one or more surfaces of the second component. That is, when a first component is "on" a second component, one or more intervening components may be present between the first and second components. In contrast, the term "directly on" is interpreted to mean that a first component is in contact with a surface (e.g., an upper surface) or a second component. Therefore when a first component is "directly on" a second component, the first component is in contact with the second component, and that no intervening components are present between the first and second components.

It should be understood that the ranges enumerated herein are for the sake of example only, unless expressly indicated otherwise. The ranges herein should also be understood to include all of the individual values of falling within the indicated range as though such values were expressly recited, and to encompass sub ranges within the indicated range as though such sub ranges were expressly recited. By way of example, a range of 1 to 10 should be understood to include the individual values of 2, 3, 4 . . . etc., as well as the sub ranges of 2 to 10, 3 to 10, 2 to 8, etc., as though such values and sub ranges were expressly recited.

The terms "substantially" and "about" when used herein in connection with an amount or range mean plus or minus 5% of the stated amount or the endpoints of the stated range.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

NON-LIMITING LIST OF REFERENCE NUMERALS AND ELEMENTS

| Reference Numeral | Elements |
|---|---|
| 10 | Solid-state automotive vehicle headlamp |
| 12 | Clamshell reflector |
| 14 | Spheroid reflector optic |
| 16 | Solid state light source |
| 18 | Clamshell cavity |
| 20 | Reflective surface |
| 22 | Open end |
| 24 | Reflective region |
| 26 | Field to be illuminated |
| 28 | Optional lens |
| 30 | Bottom surface |
| 32 | Bottom surface |
| 34 | Reflective region/surface |
| 36 | Light-transmissive window |
| 38 | Body |
| 40 | Inner surface |
| 42 | Outer surface |
| 44 | Reflector optic cavity |
| 46 | Metallic layer |
| 48 | Metallic layer |
| 50 | First portion |
| 52 | Second portion |
| 54 | Edges |
| 56 | Recessed surface |
| 58 | Exposed surface |
| R | Radius |
| C | Center |

What is claimed is:

1. A solid-state automotive vehicle headlamp (10) comprising:

a solid-state light source (16);

a clamshell reflector (12) having a reflective surface (20) defining a clamshell cavity (18) with an open end (22) facing a field to be illuminated (26); and a reflector optic (14) being defined by a portion of a substantially spherical surface (40, 42) in surrounding relation to the solid-state light source (16), the reflector optic (14) defining a light-transmissive window (36) permitting a direct line-of-sight transmission of light generated by the solid-state light source (16) to the reflective surface (20) of the clamshell reflector (12);

the reflector optic (14) further including a reflective region (34) formed on the portion of the substantially spherical surface (40) and at least partially surrounding the light-transmissive window (36) and configured to reflect light (52) generated by the solid-state light source (16) and directed at the reflector optic (14) back towards the solid-state light source (16), wherein the reflector optic (14) is positioned relative the open end (22) of the clamshell reflector (12) to prevent a line-of-sight emission of light from the solid-state light source (16) to directly exit the vehicle headlamp (10) in a direction in which the open end (22) faces, whereby the reflector optic (14) occludes a pathway for transmission of light generated by the solid-state light source (16) through the open end (22) that is not reflected off the clamshell reflector (12).

2. The solid-state automotive vehicle headlamp (10) of claim 1, wherein the reflector optic (14) includes a body (38) that is defined by the portion of the spherical surface (40, 42), and wherein the body (38) is solid with a reflector optic cavity (44) formed from a light-transmissive material.

3. The solid-state automotive vehicle headlamp (10) of claim 2, wherein the light-transmissive material comprises at least one of glass, plastic and silicone.

4. The solid-state automotive vehicle headlamp (10) of claim 2, wherein the body (38) forms a reflector optic cavity (44), and wherein an air gap is disposed between an inner surface (40) of the body (38) and the solid-state light source (16).

5. The solid-state automotive vehicle headlamp (10) of claim 1, wherein the reflective region (34) partially surrounds the light-transmissive window (36).

6. The solid-state automotive vehicle headlamp (10) of claim 1, wherein the reflective region (34) fully surrounds the light-transmissive window (36).

7. The solid-state automotive vehicle headlamp (10) of claim 1, wherein the reflective region (34) comprises at least one layer of highly-reflective metallic material (46, 48) disposed on at least one of an inner or outer surface (40, 42) a body (38) of the reflector optic (14).

8. The solid-state automotive vehicle headlamp (10) of claim 1, wherein at least a portion of the reflector optic (14) includes a substantially hemispherical shape.

9. The solid-state automotive vehicle headlamp (10) of claim 1, wherein the light transmissive window (36) is defined by a plurality of edges (54).

10. The solid-state automotive vehicle headlamp (10) of claim 1, wherein the light transmissive window (36) is defined by a single continuous edge (54).

11. The solid-state automotive vehicle headlamp (10) of claim 1, wherein the light-transmissive window (36) has a shape corresponding to a substantially rectangular shape flattened against a spherical body (38) of the reflector optic (14).

12. The solid-state automotive vehicle headlamp (10) of claim 1, wherein the solid-state light source (16) is coupled to a bottom surface (30, 32), the bottom surface (30, 32) comprising a bottom reflective region (24) proximate to and within the reflector optic (14), the bottom reflective region (24) configured to reflect light towards the reflective region (34).

13. The solid-state automotive vehicle headlamp (10) of claim 12, wherein the solid-state light source (16) further comprises at least one light emitting diode (LED) and at least one phosphor plate.

14. The solid-state automotive vehicle headlamp (10) of claim 1, wherein the reflector optic (14) at least partially faces away from the open end (22) of the clamshell reflector (12).

15. A solid-state automotive vehicle headlamp (10) comprising:

a solid-state light source (16);

a clamshell reflector (12) having a reflective surface (20) defining a clamshell cavity (18) with an open end (22) facing a field to be illuminated (26); and a reflector optic (14) being defined by a portion of a substantially spherical surface (40, 42) in surrounding relation to the solid-state light source (16), the reflector optic (14) defining a light-transmissive window (36) permitting a direct line-of-sight transmission of light generated by the solid-state light source (16) to the reflective surface (20) of the clamshell reflector (12);

the reflector optic (14) further including a reflective region (34) at least partially surrounding the light-transmissive window (36) and configured to reflect light (52) generated by the solid-state light source (16)

and directed at the reflector optic (14) back towards the solid-state light source (16), wherein at least a portion of the reflector optic (14) includes a substantially hemispherical shape.

16. The solid-state automotive vehicle headlamp (10) of claim 15, wherein inner portions of the hemispherical shape, as seen in each of two mutually orthogonal directions, face each other in confronting relation.

17. A method of emitting light from an automotive vehicle headlamp (10) comprising:

forming a reflector optic (14) having a reflective region (34) formed on a portion of a substantially spherical surface (40);

positioning the reflector optic (14) in surrounding relation to a solid-state light source (16);

transmitting, via direct line-of-sight through a light-transmissive window (36) defined in the reflector optic (14), a first portion of light (50) generated from the solid-state light source (16) to a reflective surface (20) of a clamshell reflector (12), the reflective surface (20) defining a clamshell cavity (18) with an open end (22) facing a field to be illuminated (26);

reflecting a second portion of light (52) generated from the solid-state light source (16) and directed at the reflective region (34) of the reflector optic (14) back towards the solid-state light source (16) and subsequently directing this reflected second portion of light (52) towards the reflective surface (20) of the clamshell reflector (12); and occluding, via the reflector optic (14), emission of light (50, 52) generated by the solid-state light source (16) that is not first reflected off the clamshell reflector (12) from exiting the vehicle headlamp (10).

18. A solid-state automotive vehicle headlamp (10) comprising:

a solid-state light source (16);

a clamshell reflector (12) having a reflective surface (20) defining a clamshell cavity (18) with an open end (22) facing a field to be illuminated (26); and a reflector optic (14) being defined by a portion of a substantially spherical surface (40, 42) in surrounding relation to the solid-state light source (16), the reflector optic (14) defining a light-transmissive window (36) permitting a direct line-of-sight transmission of light generated by the solid-state light source (16) to the reflective surface (20) of the clamshell reflector (12);

the reflector optic (14) further including a reflective region (34) at least partially surrounding the light-transmissive window (36) and configured to reflect light (52) generated by the solid-state light source (16) and directed at the reflector optic (14) back towards the solid-state light source (16), wherein the solid-state light source (16) is coupled to a bottom surface (30, 32), the bottom surface (30, 32) comprising a bottom reflective region (24) proximate to and within the reflector optic (14), the bottom reflective region (24) configured to reflect light towards the reflective region (34).

19. The solid-state automotive vehicle headlamp (10) of claim 15, wherein the solid-state light source (16) is coupled to a bottom surface (30, 32), the bottom surface (30, 32) comprising a bottom reflective region (24) proximate to and within the reflector optic (14), the bottom reflective region (24) configured to reflect light towards the reflective region (34).

20. The method according to claim 17, further comprising coupling the solid-state light source (16) to a bottom surface (30, 32), the bottom surface (30, 32) comprising a bottom reflective region (24) disposed within the reflector optic (14); and reflecting light that strikes the bottom reflective region (24) to the reflective region (34) of the reflector optic (14).

* * * * *